US011346508B2

(12) United States Patent
Ge

(10) Patent No.: US 11,346,508 B2
(45) Date of Patent: May 31, 2022

(54) LED FILAMENT

(71) Applicant: Tiehan Ge, Hangzhou (CN)

(72) Inventor: Tiehan Ge, Hangzhou (CN)

( * ) Notice: Subject to any disclaimer, the term of this patent is extended or adjusted under 35 U.S.C. 154(b) by 0 days.

(21) Appl. No.: 17/259,059

(22) PCT Filed: Jul. 1, 2019

(86) PCT No.: PCT/CN2019/094167
§ 371 (c)(1),
(2) Date: Jan. 8, 2021

(87) PCT Pub. No.: WO2020/019945
PCT Pub. Date: Jan. 30, 2020

(65) Prior Publication Data

US 2021/0278050 A1 Sep. 9, 2021

(30) Foreign Application Priority Data

Jul. 23, 2018 (CN) ..... 201810810033.0

(51) Int. Cl.
*F21K 9/232* (2016.01)
*F21K 9/238* (2016.01)
*F21Y 107/90* (2016.01)
*F21Y 115/10* (2016.01)

(52) U.S. Cl.
CPC ..... *F21K 9/232* (2016.08); *F21K 9/238* (2016.08); *F21Y 2107/90* (2016.08); *F21Y 2115/10* (2016.08)

(58) Field of Classification Search
CPC ..... F21K 9/232; F21K 9/238; F21Y 2107/90; F21Y 2115/10
See application file for complete search history.

(56) References Cited

U.S. PATENT DOCUMENTS

2014/0268779 A1* 9/2014 Sorensen ..... F21K 9/232 362/249.06
2016/0102812 A1* 4/2016 Chen ..... F21K 9/23 362/646
2017/0012177 A1* 1/2017 Trottier ..... F21K 9/00
2017/0167663 A1* 6/2017 Hsiao ..... F21K 9/237
2020/0347997 A1* 11/2020 Jiang ..... H05B 45/3574
2021/0199250 A1* 7/2021 Ge ..... F21K 9/232

* cited by examiner

*Primary Examiner* — Bryon T Gyllstrom
*Assistant Examiner* — Christopher E Dunay
(74) *Attorney, Agent, or Firm* — Getech Law LLC; Jun Ye

(57) ABSTRACT

An LED filament including at least one filament substrate. The at least one filament substrate each includes at least two substrate sections connected in sequence. The substrate has two opposite light-emitting surfaces. The light-emitting surfaces of adjacent substrate sections are twisted with respect to each other around the axis which is along the extending direction of the filament substrate. On the light-emitting surfaces LED light-emitting elements are provided. The LED filament structure can facilitate heat dissipation and comprises a plurality of light-emitting surfaces oriented in different directions, so that the LED filament can emit light toward a plurality of angles so as to have a more uniform and omni-directional light-emitting effect. In addition, the LED light-emitting elements on the plurality of filaments can also be electrically connected in different manners, such that LED light-emitting elements of different colors can be provided, thereby realizing the control of multiple light-emitting effects.

7 Claims, 6 Drawing Sheets

LED FILAMENT

CROSS-REFERENCE TO RELATED APPLICATIONS

This application claims the benefit of and priority to International Patent Application No. PCT/CN2019/094167 filed Jul. 1, 2019, and Chinese Patent Application No. 201810810033.0 filed on Jul. 23, 2018, the entire contents of which are incorporated herein by reference.

TECHNICAL FIELD

The present invention relates to an LED lamp, in particular to an LED filament.

BACKGROUND

In recent years, various performance of the illuminating LED lamp has been improved considerably due to the continuous development of the LED technology. The LED lamp has become the trend in the future of the light source since it has a number of advantages such as long lifetime, high luminous efficiency, no UV radiation and lower energy consumption.

However, unlike the incandescent lamp and the like which could implement 360 degree omnidirectional illumination, the LED light source has directivity, so its illuminating effect, to a certain extent, is impacted when it replaces traditional light source such as the incandescent lamp or the like as a light source, Especially when the LED is made into a traditional tube-shaped daylight lamp. As disclosed in Chinese Patent CN102022651A, the LED daylight lamp comprises a lampshade, LED light source components, an LED driving component, two end caps and a heat dissipating housing. The lampshade is connected to the heat dissipating housing, and the two end caps cover the lampshade and the heat dissipating housing which have been connected at their two ends respectively. The cross sections of the lampshade and the heat dissipating housing are both arc-shaped, and the lampshade and the heat dissipating housing form a cavity in which the LED light source components and the LED driving component are located. In this LED daylight lamp, the LEDs have to be arranged within a plane so as to meet the requirements for their heat dissipation. Thus, its light emitting area could merely cover 180-degree rather than 360-degree (i.e., it emits light from a plane), although it has a long straight tube-shape like the traditional daylight lamp. Therefore, in the current LED lamps, the heat dissipation area and the light-emitting area are contradictory. Therefore, the existing LED lamps cannot realize 360-degree light emission while meeting the heat dissipation requirements.

The LED bulbs are relatively simple in structure and function, which have only lighting functions. Therefore, other functions other than lighting cannot be realized and thus the users could not obtain other feelings and experiences from the LED bulbs.

SUMMARY

The present invention aims to provide an LED filament that could implement omnidirectional illumination and be manufactured easily as well as has good heat dissipation performance.

In order to solve the technical problem mentioned above, the present invention provides technical solutions as follows. An LED filament comprising at least one filament substrate, characterized in that: the at least one filament substrate each includes at least two substrate sections connected sequentially; a substrate section has two opposite light-emitting surfaces; the light-emitting surfaces of adjacent substrate sections are twisted with respect to each other around an axis which is along an extending direction of the at least one filament substrate; and on the light-emitting surfaces LED light-emitting elements are arranged.

Preferably, the light-emitting surfaces of the at least two substrate sections are twisted sequentially in the same rotational direction or in alternative directions around an axis which is along a longitudinal direction of the at least one filament substrate.

In order to prevent damage to the circuit on the filament substrate when it is twisted, the twist angle between the light-emitting surfaces of adjacent substrate sections is not more than 90 degrees.

Preferably, the light-emitting surfaces of every two adjacent substrate sections are twisted with respect to each other by the same angle or different angles.

Preferably, one of the two opposite light-emitting surfaces of the substrate section is provided with LED light-emitting elements or both of the two opposite light-emitting surfaces of the substrate section are provided with LED light-emitting elements.

Preferably, the at least one filament substrate includes at least two filament substrates. One end of the at least two filament substrates is connected to an external power source through a lead, and the other end of the at least two filament substrates are connected to each other through a connecting member.

Preferably, the connecting member connects the at least two filament substrates in terms of structure, with a circuit break formed between the two filament substrates 5; or the connecting member connects the at least two filament substrates in terms of structure while electrically connects the at least two filament substrates.

As a preferred embodiment of the present invention, in order to facilitate processing, the at least one filament substrate is a strip-shaped substrate, and the at least one filament substrate has two opposite surfaces. The at least one filament substrate is divided into a plurality of sections which are twisted with respect to each other around an axis which is along the extending direction of the at least one filament substrate so as to form a plurality of substrate sections. The two opposite surfaces of the at least one filament substrate form light-emitting surfaces of the substrate section.

Preferably, the substrate section is an electrically conductive substrate, an electrically insulating substrate, a PCB board, an SMD packaged element, or a COB packaged element.

Compared with the prior art, the advantage of the LED filament according to the present invention lies in the ease of manufacturing, high yield, simplicity of structure, ease of being integrated, and higher dissipating performance. Additionally, the filament substrate includes a plurality of substrate sections which are twisted with respect to each other by a certain angle, thereby forming multiple light-emitting surfaces oriented in different directions. Therefore, the LED filament can emit light toward a plurality of angles so as to have a more uniform and omni-directional light-emitting effect. In addition, the LED light-emitting elements on the plurality of filaments can also be electrically connected in different manners, such that LED light-emitting elements of different colors can be provided, thereby realizing the control of multiple light-emitting effects.

DETAILED DESCRIPTION OF EMBODIMENTS

The invention will be described in further detail with reference to the accompanying drawings.

Figure 1:
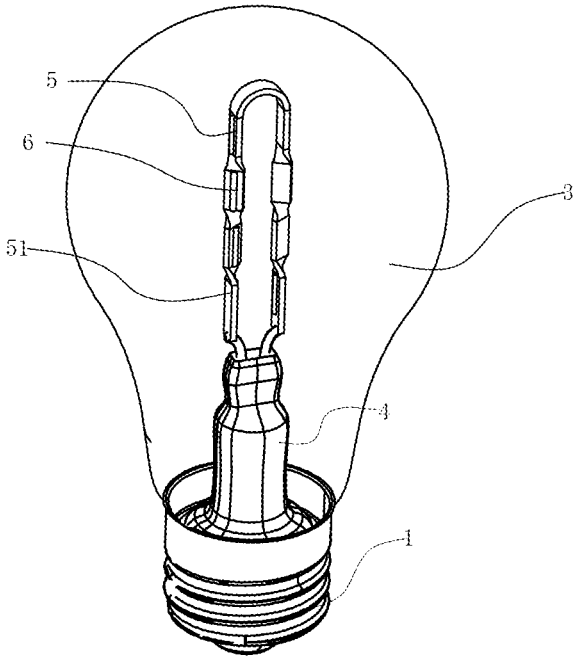
FIG. 1 illustrates a light bulb having the LED filament according to the first embodiment of the present invention.
Figure 2:
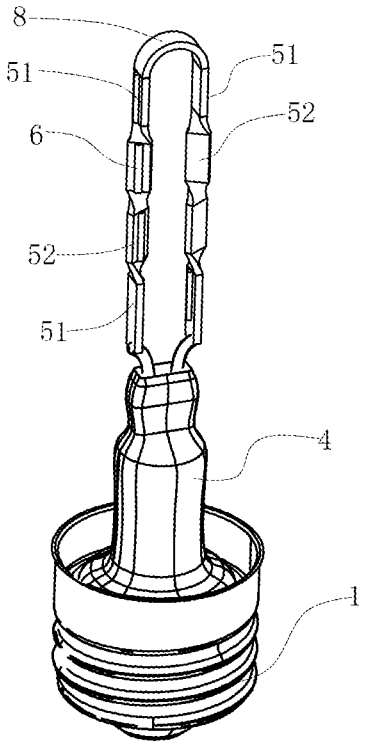
FIG. 2 illustrates the LED filament according to the first embodiment of the present invention.

As shown in FIGS. 1-2, the LED lamp according to the first embodiment of the present invention comprises a lamp base 1 and a driver located in the lamp base 1. The lamp base 1 is fixedly connected with a transparent cover 3, which is made of transparent material or has a light-transmitting structure. As shown in FIGS. 1 and 2, the transparent cover 3 is a spherical bulb.

An LED filament is fixed on the lamp base 1 within the transparent cover 3. The lamp base 1 is further connected to a connecting column 4, which is also located within the transparent cover 3. The LED filament is arranged on the connecting column 4, and the LED filament is connected to the connecting column 4 via lead wires and connected to the driver in the lamp base 1 which is used for controlling the power supply of the filament.

The LED filament, as shown in FIGS. 1 and 2, includes at least one strip-shaped filament substrate 5. At least one end of the filament substrate 5 is electrically connected to the driver in the lamp base 1 through a lead wire 7, i.e., electrically connected to the external power source. The filament substrate 5 is a strip-shaped substrate. The filament substrate 5 has two opposite surfaces. The at least one filament substrate 5 each includes at least two substrate sections 51 which are connected sequentially along the extending direction of the filament substrate 5. The adjacent substrate sections 51 are twisted with respected to each other by a certain angle around an axial direction which is along the extending direction of the filament substrate 5. Accordingly, the two opposite surfaces of one substrate section 51 are twisted with respect to the two opposite surfaces of the adjacent substrate section 51 due to the twist of the substrate sections 51, forming two opposite light-emitting surfaces 52 of the filament substrate section 51. The two opposite light-emitting surfaces 52 of the substrate section 51 are surfaces oriented in two different directions. The light-emitting surface 52 may be provided with LED light-emitting elements 6 such that light may be emitted in different directions.

Preferably, as shown in FIGS. 1 and 2, the filament substrate 5 includes a plurality of substrate sections 51 connected together. The plurality of substrate sections 51 are twisted sequentially in the same rotational direction by a certain angle around an axial direction which is along the extending direction of the filament substrate 5. As the multi substrate sections 51 are twisted in sequence, their two opposite surfaces are also twisted accordingly. That is, the light-emitting surfaces 52 are twisted as the twist of the substrate sections 51. Therefore, it can be realized that the light-emitting surfaces 52 of the plurality of substrate sections 51 are oriented in different directions, so that the light-emitting surfaces 52 of the respective one of the substrate sections 51 are twisted with respect to each other around the axis which is along the longitudinal direction of the filament substrate 5. As a result, the filament substrate can emit light in any direction such that the light emitting is more omnidirectional.

It should be pointed out that the adjacent substrate sections 51 may be twisted with respect to each other by a certain angle around the axis which is along extending direction of the filament substrate 5 in different manners. As an option, the plurality of substrate sections 51 may be twisted with respect to each other sequentially around the axis which is along the extending direction of the filament substrate 5 in the same rotational direction, for example, all in clockwise or counterclockwise direction around the axis. Optionally, the plurality of substrate sections 51 may be twisted in alternative rotational directions. That is, the twisting directions are uncertain. In addition, the twist angles between any two adjacent substrates sections 51 can be the same or different, so as to form the light-emitting surfaces 52 oriented in different directions. Moreover, LED light-emitting elements can be provided on both of the two opposite light-emitting surfaces of the substrate section 51. Alternatively, LED light-emitting elements can be provided on only one of the two opposite light-emitting surfaces of the substrate section 51. In addition, the twist angle between the adjacent substrate sections is not more than 90 degrees, preferably, not more than 45 degrees.

It should be pointed out that the above-mentioned substrate sections 51 have their light-emitting surfaces 52 oriented in the same direction before they are twisted. That is, the filament substrate 5 itself has two opposite surfaces. Therefore, after the substrate sections 51 are twisted with respect to each other, their opposite surfaces form the light-emitting surface 52 of each substrate sections 51 together with the twisting of the substrate sections 51. Thus it is formed that the light-emitting surface 52 are twisted around the axis which is along the extending direction of the filament substrate 5. The mutual twist between the substrate sections 51 aims to realize the twist between the light-emitting surfaces 52. The twist angle between the light-emitting surfaces 52 of adjacent substrate sections 51 may be the same or different. The light-emitting surfaces 52 may be twisted in the same rotational direction around the axis which is along the extending direction of the filament substrate 5, or may be twisted in alternative rotational directions.

Actually, it is also possible that the multiple substrate sections 51 of the filament substrate 5 are not twisted while their light-emitting surfaces 52 are twisted with respect to each other. The mutual twist between the substrate sections 51 aims to realize the twist between the light-emitting surfaces 52 of adjacent substrate sections 51. This aim of the present invention may be realized by twisted light-emitting surfaces 52 without twisting the substrate sections 51. Moreover, the light-emitting surfaces are twisted with respect to each other around the axis which is along the extending direction of the filament substrate 5, which means that, in the cross section perpendicular to the extending direction of the filament substrate 5, the light-emitting surfaces 52 of each substrate section 51 are staggered to be oriented in different directions around the axis which is around the extending direction of the filament substrate 5, thereby realizing multi-angle omni-directional illumination.

In this way, the processing the filament may be completed by providing LED light-emitting elements on the entire strip-shaped filament substrate 5, twisting the filament substrate 5 with substrate sections 51 twisted to each other, and then fixing the entire filament substrate 5 with twisted substrate sections 51 on the connecting column 4. The twist angle between adjacent substrate sections 51 does not exceed 60 degrees. That is, the twist angle between the light-emitting surfaces 52 of adjacent substrate sections does not exceed 60 degrees. Therefore, the twist of the filament substrate 5 would not cause break or damage to the connection line. In addition, a filament substrate that emits light in multiple directions can be obtained.

In addition, the LED lamp may have two vertically arranged filament substrates as shown in FIGS. 1 and 2. The top ends of the two filament substrates are connected by a connecting member 8. The combination of the filament substrates 5 and the connecting member 8 is U-shaped. The bottom ends of the filament substrates 5 are respectively connected to the connecting column 4. The filament substrate 5 may also have other shapes. The connecting member 8 can connect two filament substrates in terms of their circuit and structure at the same time. Alternatively, the connecting member 8 only connect two filament substrates in terms of their structure, with a circuit break formed between the two filament substrates 5.

Figure 9:
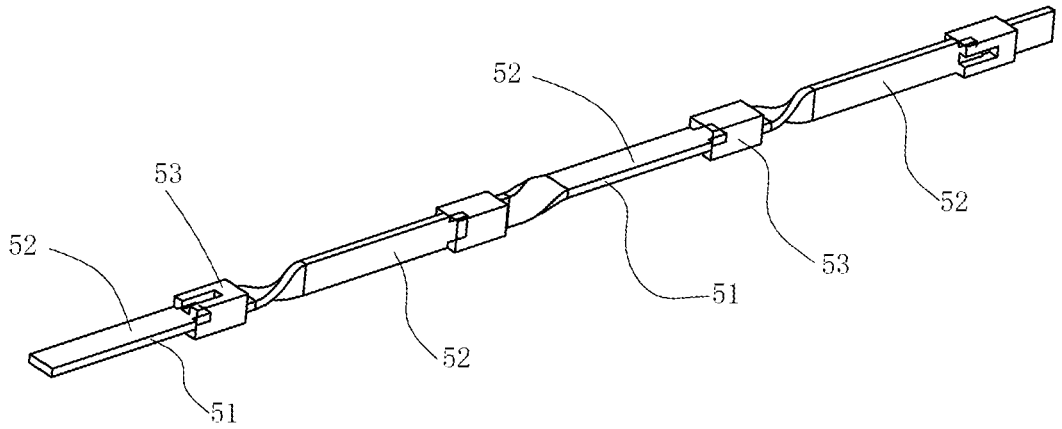
FIG. 9 schematically illustrates a filament substrate according to an embodiment.

The material of the filament substrate 5 includes but is not limited to metal, organic glass, PVC, plastic, sapphire, ceramic and silica gel. The filament substrate 5 may be formed from one of the materials as described above, or may be fabricated by splicing and/or embedding from multiple materials in the materials as described above. For example, as shown in FIG. 9, it schematically illustrates a filament substrate 5. The filament substrate 5 is a metal strip substrate, and the filament substrate 5 itself is led out as a lead. There are multiple areas on the filament substrate 5 for arranging the LED light-emitting elements so as to form a plurality of substrate sections 51 that are sequentially connected along the extending direction of the filament substrate 5. Each substrate section 51 includes two opposite light-emitting surfaces 52. The light-emitting surface 52 is provided with LED light-emitting elements. The light-emitting surfaces 52 of the substrate sections 51 are mutually twisted with respect to each other around the axis which is along the extending direction of the filament substrate 5. No LED light-emitting element is provided at the twisted position. In addition, in order to ensure that there is no short circuit, a open circuit connector 53, which only connect two substrate sections in terms of their structure with a circuit break formed there between, is provided on each or multiple substrate sections 51, so that a circuit break and a structural connection are formed between the multiple substrate sections 51. In this case, the substrate section 51 may also be a metal substrate.

Figure 10:
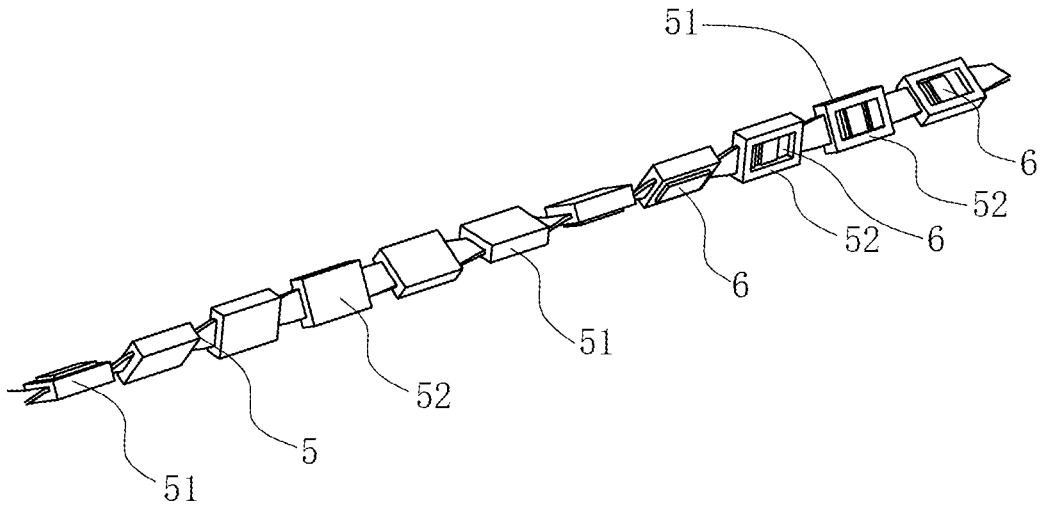
FIG. 10 schematically illustrates a filament substrate according to another embodiment.

Therefore, those skilled in the art can understand that the filament substrate 5 may be a metal substrate (i.e., an electrically conductive substrate), a PCB (Printed Circuit Board) board, or other electrically insulating substrate, such as glass, etc. As shown in FIG. 10, the filament substrate 5 is a strip-shaped connecting substrate, and a plurality of SMD (Surface Mounted Devices) packaged elements are fixedly connected to the strip-shaped connecting substrate. Each of the plurality of SMD packaged elements is a substrate section 51. The SMD packaged element includes two opposite light-emitting surfaces 52, and at least one light-emitting surface 52 is provided with a packaged LED light-emitting element 6. Therefore, the form of the substrate section 51 can be of various types, as long as it has two opposite light-emitting surfaces on which LED light-emitting elements can be arranged. The substrate can also be a COB (Chips on Board) package element.

The LED light-emitting elements can be connected in parallel or in series. The LED light-emitting elements may be LED chips or LED lamp beads. The LED chips can be vertical chips, horizontal chips, white light chips or flip chips. Furthermore, the LED light-emitting element of the filament substrate 5 can be fixed on the filament substrate 5 with transparent glue, conductive glue (such as silica gel, modified resin, epoxy resin, silver glue or copper glue), and then the LED light-emitting elements can be connected in series or in parallel through the chip connecting wires arranged on the filament substrate 5 or the wires preformed on the filament substrate 5. The outer side of the LED light-emitting element 6 may also be coated with a transparent medium layer with protection or light-emitting function. As shown in FIG. 10, some of the LED light-emitting elements 6 are provided with a transparent medium layer, while some of the LED light-emitting elements 6 are not provided with a transparent medium layer. The material of the transparent medium layer is one of silica gel, epoxy resin and LED light-emitting powder glue, or the combination of some of them.

The filament substrate 5 includes a plurality of substrate sections 51. The plurality of substrate sections 51 may be separately preformed and then be connected to each other. Optically, the filament substrate 5 may be an integrated strip-shaped substrate. After the filament substrate 5 is divided into multiple substrate sections, the filament substrate 5 is twisted around an axis which is along the extending direction of the filament substrate 5 with the substrate sections 51 twisted with respect to each other, thereby realizing the mutual twisting between the light-emitting surfaces 52 of the substrate sections 51. No LED light-emitting element is provided at the twisted position.

Preferably, the filament substrate 5 is a strip-shaped substrate with two opposite light-emitting surfaces. The LED light-emitting elements 6 may be provided on a portion of the light-emitting surface, one light-emitting surface or both light-emitting surfaces. The filament substrate 5 is twisted around the axis which is along its longitudinal direction, so that the filament substrate 5 is in the form of multiple twisted substrate sections 51, thereby forming the mutual twisting between the light-emitting surfaces 52 of the multiple substrate sections 51. It should be pointed out that such a strip-shaped filament substrate 5 may be processed into a plurality of substrate sections 51, so that the LED light-emitting elements 6 can be arranged and processed before the filament substrate 5 is twisted, which is not only convenient and effective for processing, but also leads to even light emitting.

Figure 3:
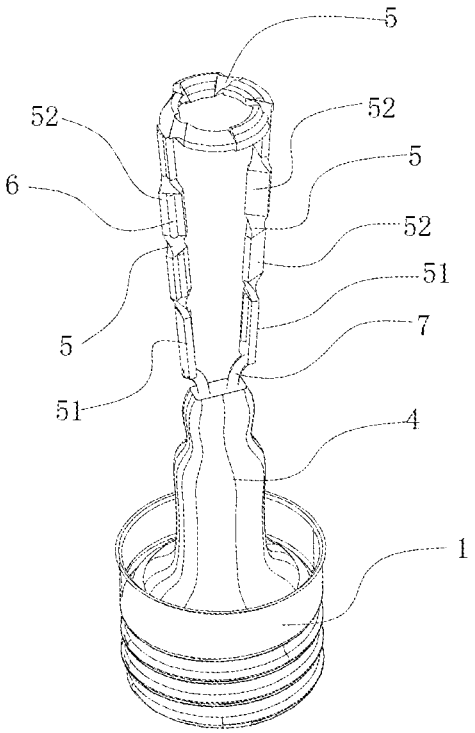
FIG. 3 illustrates the LED filament according to the second embodiment of the present invention.

As shown in FIG. 3, it is the second embodiment of the present invention. The LED filament in this embodiment includes three strip-shaped filament substrates 5, including two at the bottom and one at the top. The filament substrate 5 at the top has a ring shape and its two sides are respectively connected to the tops of the two filament substrates 5 at the bottom. The two filament substrates 5 at the bottom are connected to the connecting column 4 with their bottom ends. The three filament substrates 5 can be connected by connecting wires, or the three filament substrates may be connected directly. Each filament substrate 5 is divided into multiple substrate sections 51 along its extending direction. The substrate sections 51 are twisted with respect to each other by certain angle around the axis which is along the extending direction of the filament substrate 5. Therefore, those skilled in the art can understand that the filament substrate 5 is not necessarily a straight line, but also may be ring-shaped, S-shaped, or other regular or irregular shapes, as long as the light-emitting surfaces on the substrate are twisted with respect to each other around the axis that is along the extending direction of the filament substrate.

Figure 4:
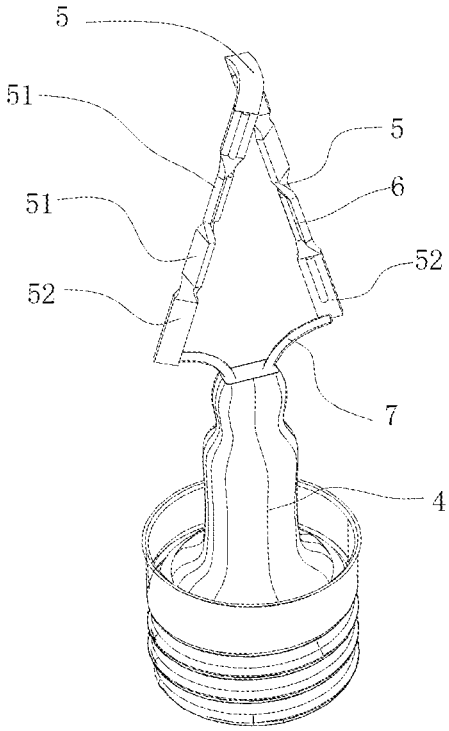
FIG. 4 illustrates the LED filament according to the third embodiment of the present invention.

As shown in FIG. 4, it is the third embodiment of the present invention. The LED filament in this embodiment includes two strip-shaped filament substrates 5, and the two filament substrates 5 are arranged in an A-shaped form. Their upper ends are connected to each other, and their lower ends are connected to the connecting column 4. Each filament substrate 5 includes a plurality of substrate sections 51 which are twisted with respect to each other around the axis which is along the extending direction of the filament substrate 5. The light-emitting surfaces 52 of the substrate sections 51 are mutually twisted around the axis which is along the extending direction of the filament substrate 5. Each substrate section 51 is provided with LED light-emitting elements 6. In addition, those skilled in the art may also find that the two filament substrates 5 may be two separate filament substrates 5 which are fixedly connected to each other at their top. Alternatively, they may be formed from a whole strip-shaped filament substrate by deforming it.

Figure 5:
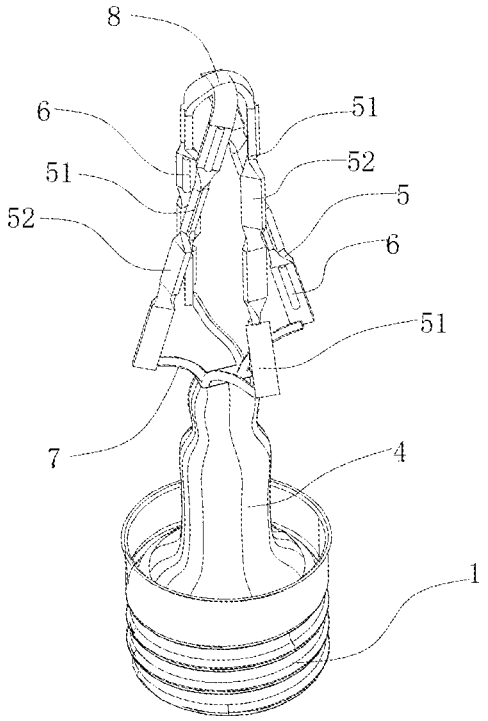
FIG. 5 illustrates the LED filament according to the fourth embodiment of the present invention.

As shown in FIG. 5, it is the fourth embodiment of the present invention. In this embodiment, the LED filament includes four filament substrates 5. The top ends of the four filament substrates 5 are connected to each other by a connecting member 8. The bottom ends of the four filament substrates 5 are all connected to the connecting column 4 through the lead 7. The four filament substrates 5 are evenly distributed in the circumferential direction from the top to the bottom, and are scattered downward and outward. In addition, each filament substrate 5 includes a plurality of substrate sections 51. The plurality of substrate sections 51 are twisted with respect to each other in sequence around the axis by a certain angle which is along the extending direction of the filament substrate 5. It should be pointed out that in the case where the LED filament includes multiple filament substrates, the multiple filament substrates 5 may be connected to each other, or not connected to each other with each connected to the lamp base 1 directly or through leads.

Figure 6:
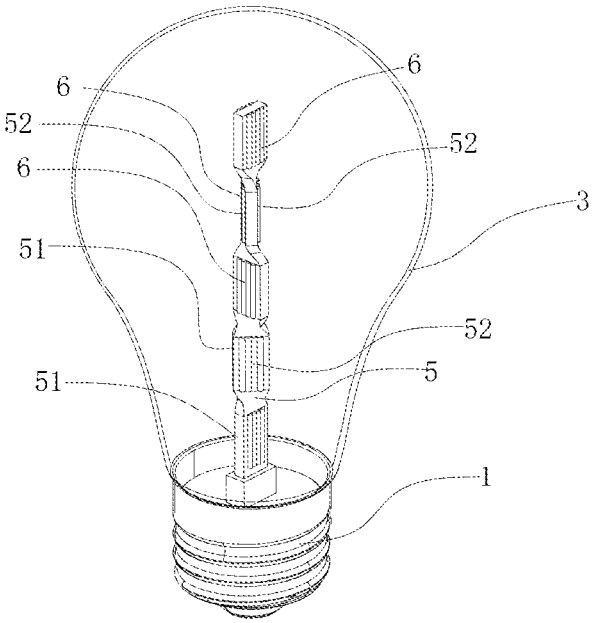
FIG. 6 schematically illustrates a light bulb having the LED filament according to the fifth embodiment of the present invention.

As shown in FIG. 6, it is the fifth embodiment of the present invention. The bulb in this embodiment is also a spherical bulb, that is, the transparent cover 3 is spherical. The bottom of the transparent cover 3 is fixedly connected to the lamp base 1. A filament substrate 5 is arranged in the transparent cover 3. The filament substrate 5 is vertically arranged on the lamp base 1. One end of the filament substrate 5 is fixed and electrically connected to the lamp base 1. The filament substrate 5 includes a plurality of substrate sections 51. The plurality of substrate sections 51 are mutually twisted around the axis which is along the extending direction of the filament substrate 1, i.e., the vertical direction, and the twisting angle is not more than 60 degrees. The filament substrate 5 has two opposite light-emitting surfaces 52. As the plurality of substrate sections 51 are twisted, the light-emitting surfaces 52 of each substrate section 51 are also mutually twisted accordingly, forming a plurality of light-emitting surfaces oriented in different directions. The two light-emitting surfaces 52 of the plurality of substrate sections 51 are both provided with LED light-emitting elements 6.

Figure 7:
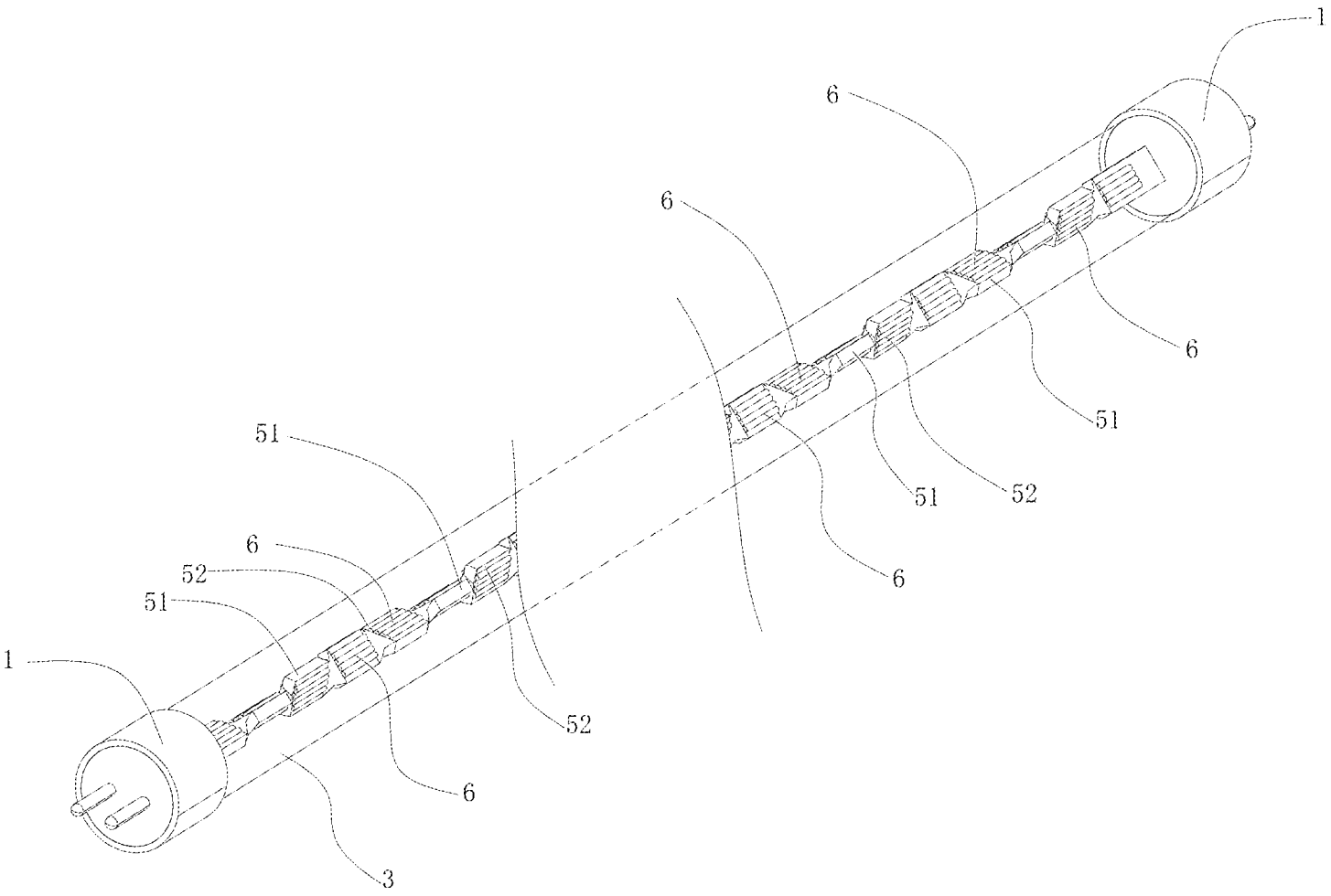
FIG. 7 schematically illustrates a light bulb having the LED filament according to the sixth embodiment of the present invention.

As shown in FIG. 7, it is the sixth embodiment of the present invention. The lamp in this embodiment is a tube lamp. The transparent cover 3 is tube-shaped. There are two LED filaments in the hollow transparent cover 3. Both LED filaments are connected with one of their ends to the lamp base 1 respectively at the ends of the transparent cover 3. Inside the lamp base 1 there is provided with a driver for electrical connection with an external power source. The LED filament includes a strip-shaped filament substrate 5. The filament substrate 5 itself has two opposite surfaces. The filament substrate 5 is divided into a plurality of substrate sections 51. The plurality of substrate sections 51 are twisted with respect to each other around the axis which is along the extending direction of the filament substrate 5. The two opposite surfaces of the filament substrate 5 may form the two opposite light-emitting surfaces 52 of the substrate section 51. The light-emitting surfaces 52 of each substrate section 51 are twisted in sequence around the axis which is along the extending direction of the filament substrate 5 by a certain angle, which is less than 60 degrees. Therefore, the plurality of light-emitting surfaces 52 are oriented in different directions, thereby realizing multi-angle LED light emission. The two opposite light-emitting surfaces 52 of the substrate section 51 may both be provided with LED light-emitting elements 6.

Figure 8:
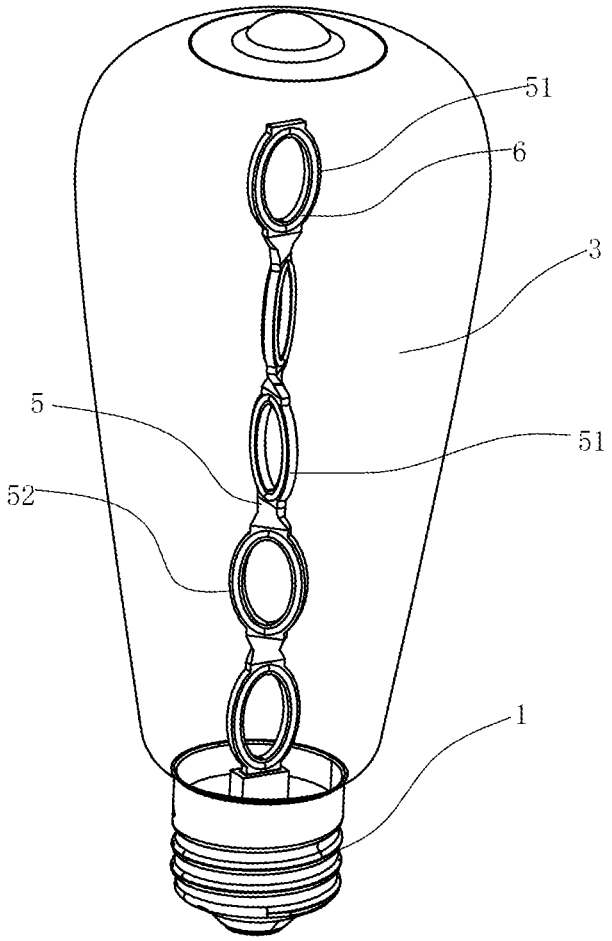
FIG. 8 schematically illustrates a light bulb having the LED filament according to the seventh embodiment of the present invention.

As shown in FIG. 8, it is the seventh embodiment of the present invention. In this embodiment, the transparent cover 3 is an ST64 bulb, with an LED filament arranged therein. One end of the LED filament is fixedly connected to the lamp base 1. The LED filament includes a strip-shaped filament substrate 5 which has a plurality of substrate sections 51 connected in sequence. The substrate section 51 is ring-shaped and has opposite light-emitting surfaces 52. In the above several embodiments, each light-emitting surface 52 is a plane surface, but those skilled in the art may understand that the light-emitting surface 52 may also be a curved surface, or other type of surface, such as a concave surface, or a convex surface, or a semi-concave and semi-convex surface, or an irregular curved surface. It is only necessary that the two light-emitting surfaces 52 of the substrate section 51 have opposite directions. The annular substrate section 51 is provided with annularly distributed LED light-emitting elements 6. It should be pointed out that the shape of the substrate section 51 may not be limited to the above-mentioned shape. The substrate section 51 may be a ring, a square, or other regular or irregular shapes. The shape of each substrate section 51 may be the same or different, which may be arranged as required.

The above LED filament structure has the advantage of ease of manufacturing, high yield, simplicity of structure, and ease of being integrated. Moreover, the multiple filament substrates can be combined into various configurations. Between the filament substrates there is a large gap so as to facilitate heat dissipation. Additionally, the filament substrate includes a plurality of substrate sections which are twisted with respect to each other by a certain angle, thereby forming multiple light-emitting surfaces oriented in different directions. Therefore, the LED filament can emit light toward a plurality of angles so as to have a more uniform and omni-directional light-emitting effect. In addition, the LED light-emitting elements on the plurality of filaments can also be electrically connected in different manners (such as in series, or parallel, etc.), such that LED light-emitting elements of different colors can be provided, thereby realizing the control of multiple light-emitting effects. In addition, the LED filament can be used in a variety of bulb structures, such as bulb lamps, or tubular lamps, etc. Those skilled in the art can have different designs as required. The LED filament has a wide range of applications.

Although the preferred embodiments of the present invention have been described above in detail, the person skilled in the art should clearly understand that various modification and alteration to the present invention are possible. Any modification, equivalent replacement and improvement within the spirits and principles of the present invention all fall into the protection scope of the present invention.

What is claimed is:

1. An LED filament comprising at least one filament substrate, characterized in that:

the at least one filament substrate each includes at least two substrate sections connected sequentially; a substrate section has two opposite light-emitting surfaces; the light-emitting surfaces of adjacent substrate sections are twisted with respect to each other around an axis which is along an extending direction of the at least one filament substrate; and on the light-emitting surfaces LED light-emitting elements are arranged, wherein the at least one filament substrate includes at least a first filament substrate and a second filament substrate, each of which includes a first end and a second end, wherein the first end of the first filament substrate and the first end of the second filament are connected to each other through a connecting member, wherein the second end of the first filament substrate is connected to an external power source through a first lead; and wherein the second end of the second filament substrate is connected to the external power source through a second lead, and wherein the connecting member connects the first filament substrate and the second filament substrate in terms of structure, with a circuit break formed between the first filament substrate and the second filament substrate.

2. The LED filament according to claim 1, characterized in that: the light-emitting surfaces of the at least two substrate sections are twisted sequentially in the same rotational direction or in alternative directions around an axis which is along a longitudinal direction of the at least one filament substrate.

3. The LED filament according to claim 1, characterized in that:

the light-emitting surfaces of adjacent substrate sections are twisted with respect to each other by an angle of no more than 90 degrees.

4. The LED filament according to claim 1, characterized in that:

the light-emitting surfaces of every two adjacent substrate sections are twisted with respect to each other by the same angle or different angles.

5. The LED filament according to claim 1, characterized in that: one of the two opposite light-emitting surfaces of the substrate section is provided with LED light-emitting elements or both of the two opposite light-emitting surfaces of the substrate section are provided with LED light-emitting elements.

6. The LED filament according to claim 1, characterized in that:

the at least one filament substrate is a strip-shaped substrate; the at least one filament substrate has two opposite surfaces; the at least one filament substrate is divided into a plurality of sections which are twisted with respect to each other around an axis which is along the extending direction of the at least one filament substrate so as to form a plurality of substrate sections; and the two opposite surfaces of the at least one filament substrate form light-emitting surfaces of the substrate section.

7. The LED filament according to claim 1, characterized in that:

the substrate section is an electrically conductive substrate, an electrically insulating substrate, a PCB board, an SMD packaged element, or a COB packaged element.

* * * * *